United States Patent [19]

Fletcher

[11] 4,136,993

[45] Jan. 30, 1979

[54] APPARATUS FOR FORMING KEYWAY JOINTS

[75] Inventor: Lawrence J. Fletcher, Ida Grove, Iowa

[73] Assignee: Gomaco Corporation, Ida Grove, Iowa

[21] Appl. No.: 841,843

[22] Filed: Oct. 13, 1977

[51] Int. Cl.[2] ..... E01C 23/02

[52] U.S. Cl. ..... 404/88; 404/100

[58] Field of Search ..... 404/87, 88, 84, 83, 404/100

[56] References Cited

U.S. PATENT DOCUMENTS

| | | | |
|---|---|---|---|
| 3,269,282 | 8/1966 | Beesley | 404/87 |
| 3,491,661 | 1/1970 | Hudis | 404/87 |
| 3,530,776 | 9/1970 | Hudis | 404/87 |
| 3,876,323 | 4/1975 | Williams | 404/87 |

*Primary Examiner*—Nile C. Byers, Jr.

*Attorney, Agent, or Firm*—Henderson, Strom, Sturm, Cepican & Fix

[57] ABSTRACT

An apparatus for continuously forming and positioning a keyway joint is removably coupled to the front end of a slip-form paving machine. A supply roll of key strip stock is mounted on the apparatus and the strip is guided to successive arrangements of forming rollers for shaping the strip into a desired form. An automatic punch mechanism is provided for pucnhing holes in the strip liner and an automatic tie bar mechanism is also associated with the apparatus for automatically placing tie bars into these holes. Because it is difficult to assure that such tie bars are properly placed in the holes and since an improperly positioned tie bar can cause serious damage to the keyway and pavement already laid, a mechanism is provided for shutting down the paving machine if such tie bars are not properly placed.

9 Claims, 23 Drawing Figures

10
11
12
13
14
16
17
18
19
21
22
23
38
39
41
52
53
56
57
58
59'
65
66
67
77
80
83
84
85
86
87
88
89
90
91
92
93
125
3.
5.
16.

APPARATUS FOR FORMING KEYWAY JOINTS

BACKGROUND OF THE INVENTION

This invention relates to an apparatus for forming, punching and positioning a continuous key joint strip and automatically inserting tie bars, which apparatus is particularly useful in combination with a slip-form roadway paver to form and position a continuous key joint with bars placed in proper position and with a pavement being formed in a continuous fashion as the paver moves forwardly over a road bed.

In building roads and highways it is common practice to construct the road by forming concrete slabs arranged in side-by-side relation. In connecting these adjacent slabs, the road building industry has adopted the use of keys and key slots at the abutting side edges of adjacent concrete slabs. Steel tie rods or bars are often mounted in conjunction with the key slots to prevent separation of the slabs. The common practice used to develop these key slots has been to mount a mold or key strip to the inner face of a road form. When using steel tie bars, half of the bar extends into the formed slab and the other half of the bar is bent 90° and hidden within the key slot on the inner face of the road form. After the cast slab has hardened, the key strips are removed and the tie bars may later be straightened out to provide connection with the adjacent slab. This method was considered generally satisfactory with prior art road forming equipment where the roads were formed section-by-section rather than continuously as is now possible with modern and faster paving machines such as those known as slip form pavers.

In using a slip form paver, a concrete slab is formed in an automatic continuous fashion. As a result, the aforementioned prior art methods of forming key joints are entirely inadequate in that the advantages of speed and simplicity of the slip form paver are defeated by using the prior art step-by-step methods of forming the key joints.

U.S. Pat. No. 3,491,661 discloses an apparatus for automatically forming slip form keyway joints and U.S. Pat. No. 3,530,776 discloses an apparatus for automatically placing tie bars in such a keyway. The problem with such structures is that they are unduly complicated and if such structures malfunction, the keyway is torn out, which is a very costly, timely, and complicated situation to solve.

SUMMARY OF THE INVENTION

The present invention relates to an apparatus for continuously forming a key joint which is positioned in engagement with the abutting edge of a concrete slab being formed by a slip form paver in a continuous fashion. The key strip liner is fed from a supply roll mounted on the apparatus to successive arrangements of forming rolls where the key joint is progressively shaped. A punch mechanism is provided for automatically punching holes in key joint liner and a tie bar inserting mechanism is provided for automatically placing tie bars in each of the holes. A further mechanism is provided shutting off the slip form paver should the tie bar inserting mechanism not fully insert a tie bar within a predetermined amount of time.

An object of the invention is to provide an improved apparatus for forming keyway joints in conjunction with a slip form paver.

Another object of the invention is to provide an improved tie bar inserting mechanism for a keyway forming apparatus.

A further object of the invention is to provide a mechanism for automatically shutting down a slip forming machine with keyway forming apparatus associated therewith if a tie bar becomes jammed or is not properly inserted.

Other objects, advantages, and novel features of the present invention will become apparent from the following detailed description of the invention when considered in conjunction with the accompanying drawings.

DESCRIPTION OF THE PREFERRED EMBODIMENT

Figures 1, 2:
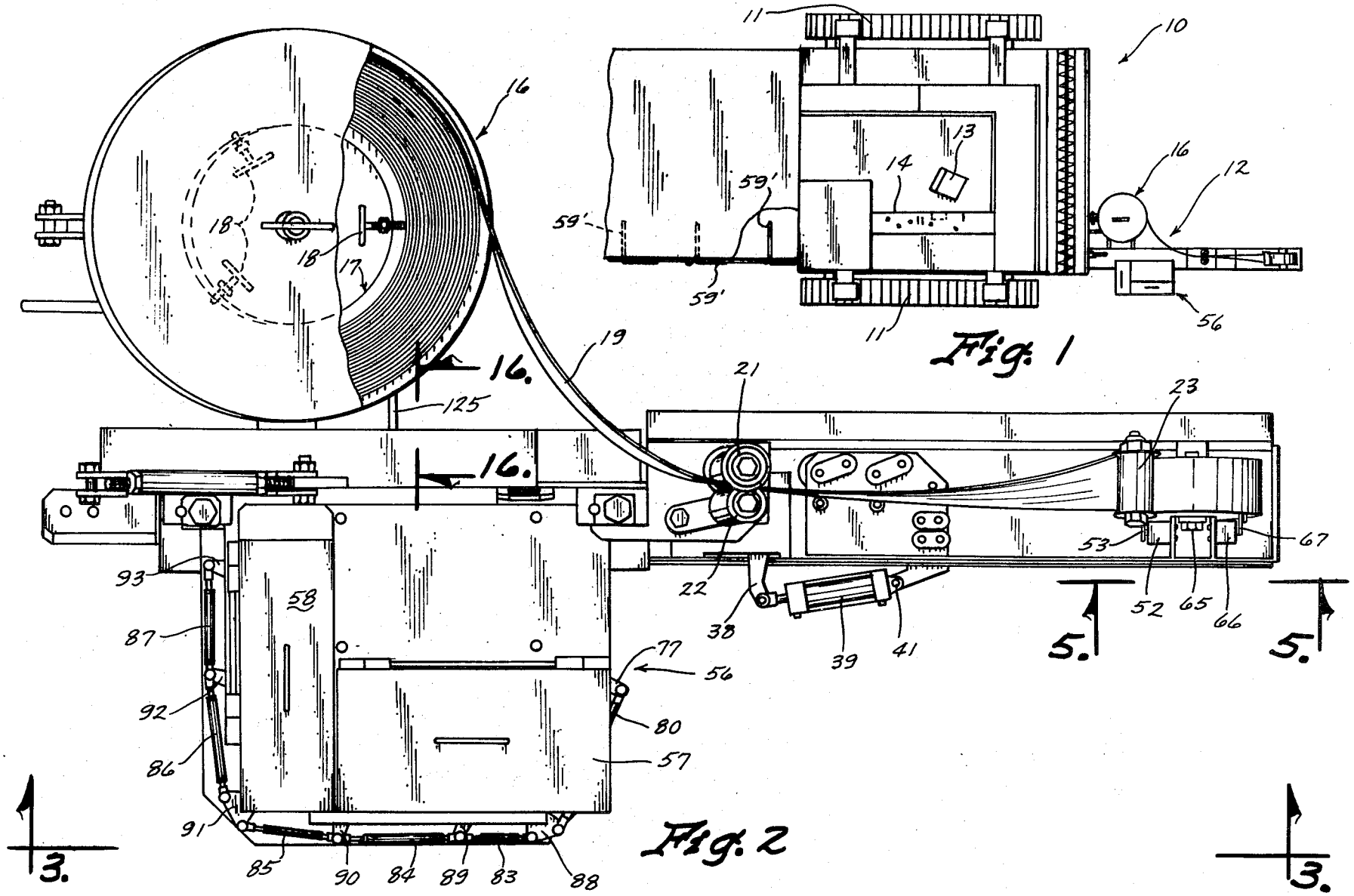
FIG. 1 is a plan view of the present invention in operation.
FIG. 2 is an enlarged close-up view of the apparatus for forming keyway joints attached to the front end of the concrete forming machine of FIG. 1.

Referring now to the drawings wherein like reference materials designate identical or corresponding parts throughout the several views, FIG. 1 shows a concrete slab forming machine 10 which can be of a type as shown in U.S. Pat. No. 3,779,661 to Godbersen and being movable by means of track members 11. An apparatus 12 for forming keyway joints is attached to the front of the machine 10. The concrete slab forming machine 10 is controlled by an operator from a chair 13 adjacent to a control panel 14.

Figures 3, 4, 5:
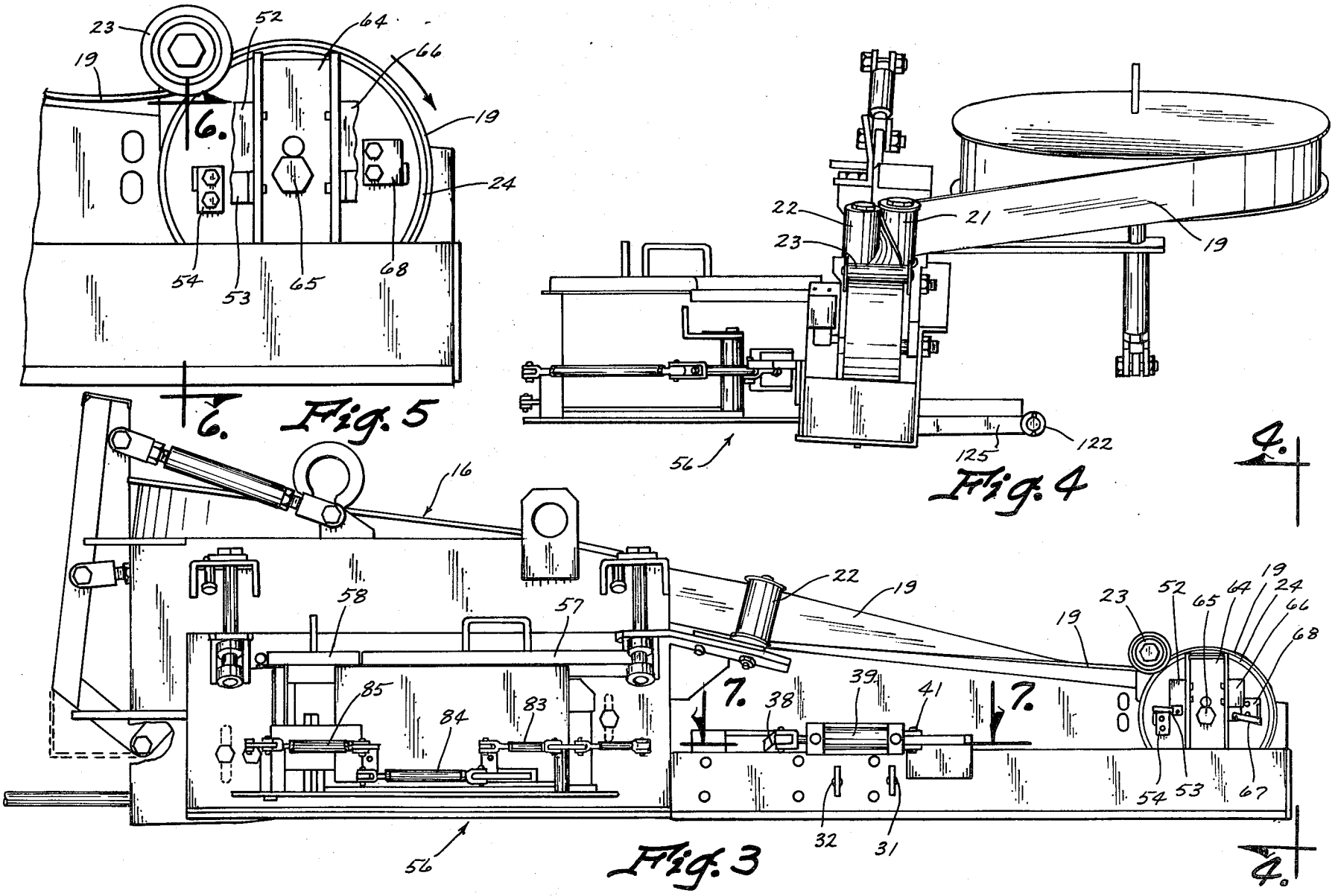
FIG. 3 is an enlarged side elevational view of the mechanism shown in FIG. 2 and taken along line 3—3 of FIG. 2.
FIG. 4 is a front elevational view taken along line 4—4 of FIG. 3.
FIG. 5 is a partial enlarged side elevational view like FIG. 3, showing only the forwardmost end of the apparatus for forming keyway joints.

Referring to FIGS. 2, 3 and 4, it is noted that a roll 16 of metal, such as sheet steel, is disposed on a spool 17 and held in place by set screw devices 18. This spool 17 is freely rotatably mounted to the machine 10 and the strip of metal 19 extends through a first pair of guiding rollers 21 and 22 to a guiding roller 23 which causes the material 19 to pass over a wheel or drum 24 which can best be seen in FIGS. 3 and 5. The metal 19, once it has passed over the wheel or drum 24, is guided through a first pair of forming rollers 26 and 27 and a second and final pair of guiding rollers 28 and 29. Consequently, the metal strip 19 assumes a final shape as shown in FIG. 9.

Figure 7:
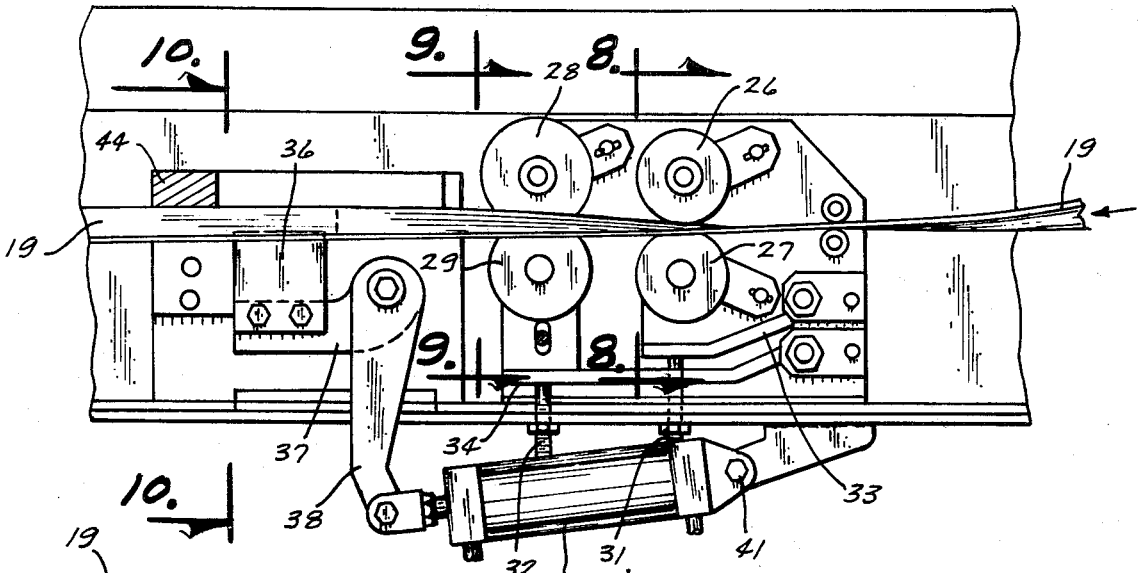
FIG. 7 is a partial cross-sectional view taken along line 7—7 of FIG. 3.
Figure 8:
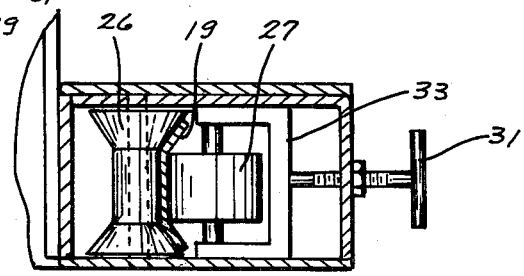
FIG. 8 is a cross-sectional view taken along line 8—8 of FIG. 7.
Figure 9:
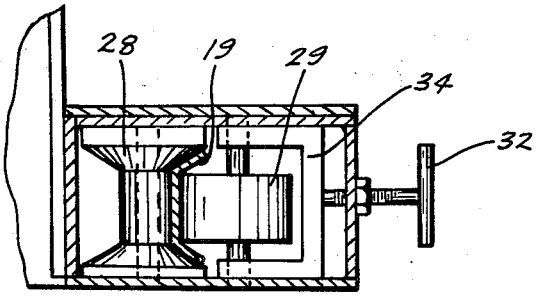
FIG. 9 is a partial cross-sectional view taken along line 9—9 of FIG. 7.

Set screw members 31 and 32, as shown in FIGS. 7, 8 and 9, are used to adjust the position of the rollers 27 and 29, respectively, with respect to the rollers 26 and 28, respectively, for adjusting the final size and shape of the metal strip 19. Yokes 33 and 34 are used in conjunction with the set screw devices 31 and 32, respectively, as will be clear from FIGS. 7, 8 and 9.

Figure 11:
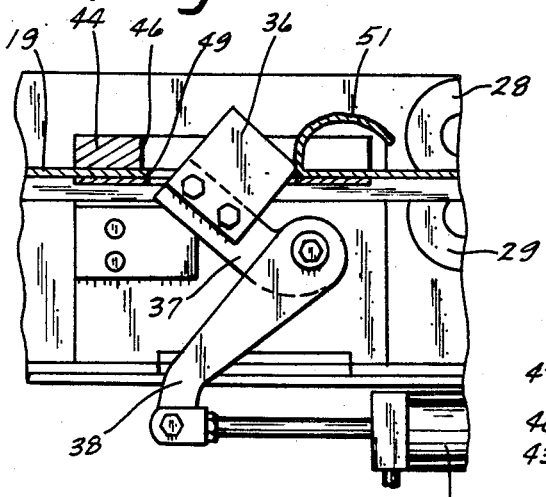
FIG. 11 is a top view of the punch mechanism shown in FIG. 10.
Figure 10:
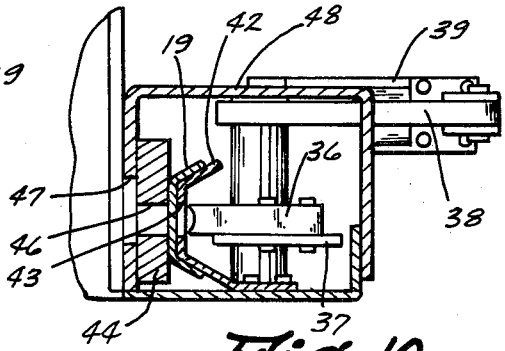
FIG. 10 is a partial cross-sectional view taken along line 10—10 of FIG. 7.

Once the metal strip 19 passes through the aforesaid forming rollers, it enters a punching section. Referring to FIGS. 7, 10 and 11, it is noted that a punching blade 36 is pivotally attached to the framework by an arm 37. This arm 37 is rigidly attached to another arm 38 which is, in turn, pivotally attached to a hydraulic cylinder 39, which hydraulic cylinder 39 is pivotally attached to the machine by means of a bolt 41. The keyway lining metal sheet 19 passes over a guide member 42, shown clearly in FIG. 10, and this guide member 42 has an opening 43 therein for reception of the punching blade 36. On the other side of the guide 42 is an anvil section 44 having an opening 46 therein for allowing the punching blade 36 to extend therein. An opening 47 is also disposed in the framework 48 for allowing the punching blade 36 to extend that far if necessary.

Figure 18:
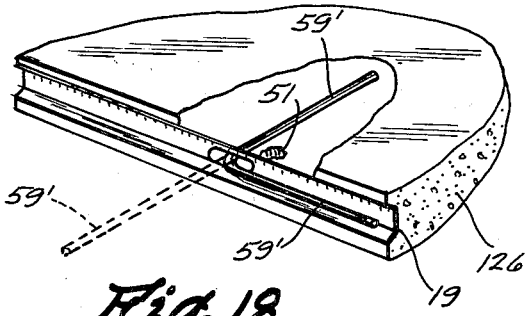
FIG. 18 is a partial perspective view of a section of a concrete slab which has been formed by the mechanism of this invention.
Figure 19:
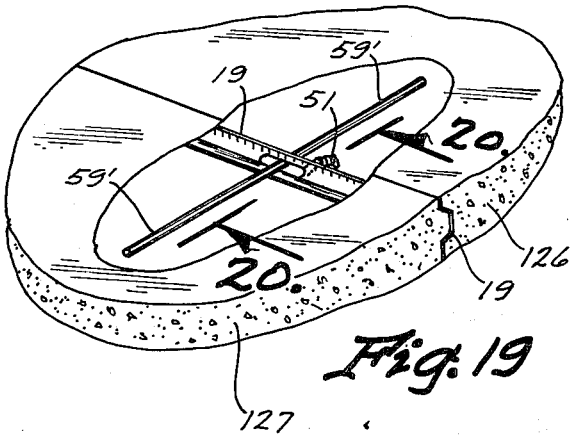
FIG. 19 is a view like FIG. 18, but showing a second slab of concrete formed adjacent to a first slab.

Ordinarily, the double acting hydraulic cylinder 39 is in the position shown in FIG. 7; and, when it is extended, as is shown in FIG. 11, then a hole 49 is punched through the lining 19 and forms a bur 51 which helps maintain the lining 19 attached to the concrete slab as will be apparent from FIGS. 18 and 19. The punch 36 is actuated in response to the tripping of a switch 52 which has an arm 53 pivotally attached thereto. A cam member 54 (FIGS. 3, 5 and 21–23), rigidly attached to the wheel 24 contacts the arm 53 once during each revolution of the wheel 24 and thereby causes the hydraulic cylinder to extend and retract, thereby punching a hole in the lining 19 at predetermined intervals.

Once the lining 19 has been punched, the automatic bar inserting mechanism 56, shown in FIGS. 2, 3, 12, 13, 14 and 15, passes by the lining 19, which has at that time already been placed into the edge of the concrete slab, for example, as explained in U.S. Pat. No. 3,491,661. The tie bar inserting mechanism 56 has a pair of doors 57 and 58 (FIG. 2) which can be pivotally opened such that a plurality of L-shaped tie bars 59 can be stacked within a magazine section, including walls 61 and 62. At the bottom of this magazine section, including walls 61 and 62, is a shelf 63 which can clearly be seen in FIG. 15, for example. This shelf 63 supports the entire column of tie bars 59.

Figure 6:
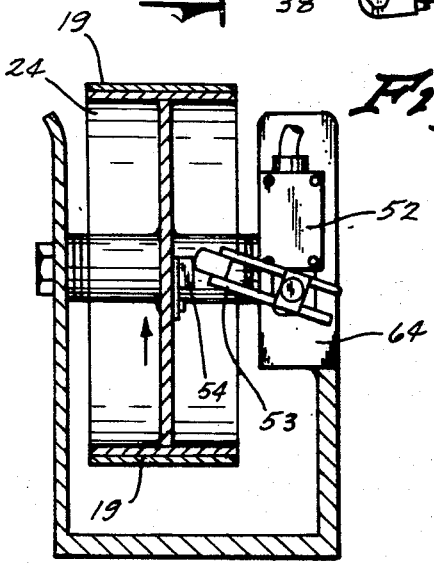
FIG. 6 is a cross-sectional view taken along line 6—6 of FIG. 5.

Attention is again directed to FIG. 3 which shows a post 64 to which the switch 52 of FIG. 6 is attached. Also attached to this post 64 is a second switch 66 which has an arm 67 pivotally attached thereto and this switch, including members 66 and 67, are substantially identical to the switch and arm members 52 and 53 shown in FIG. 6. A cam member 68 is attached to the wheel or drum 24 outwardly of the cam 54. The reason that the cams and arms are at a different distance from the center bolt 65 representing the axis of the drum 24 is so that the cam 68 will only actuate the switch 66 and so that the cam 54 will only actuate with switch 52, whereby each of these switches will be actuated only once during one revolution of the wheel or drum 24.

Figure 12:
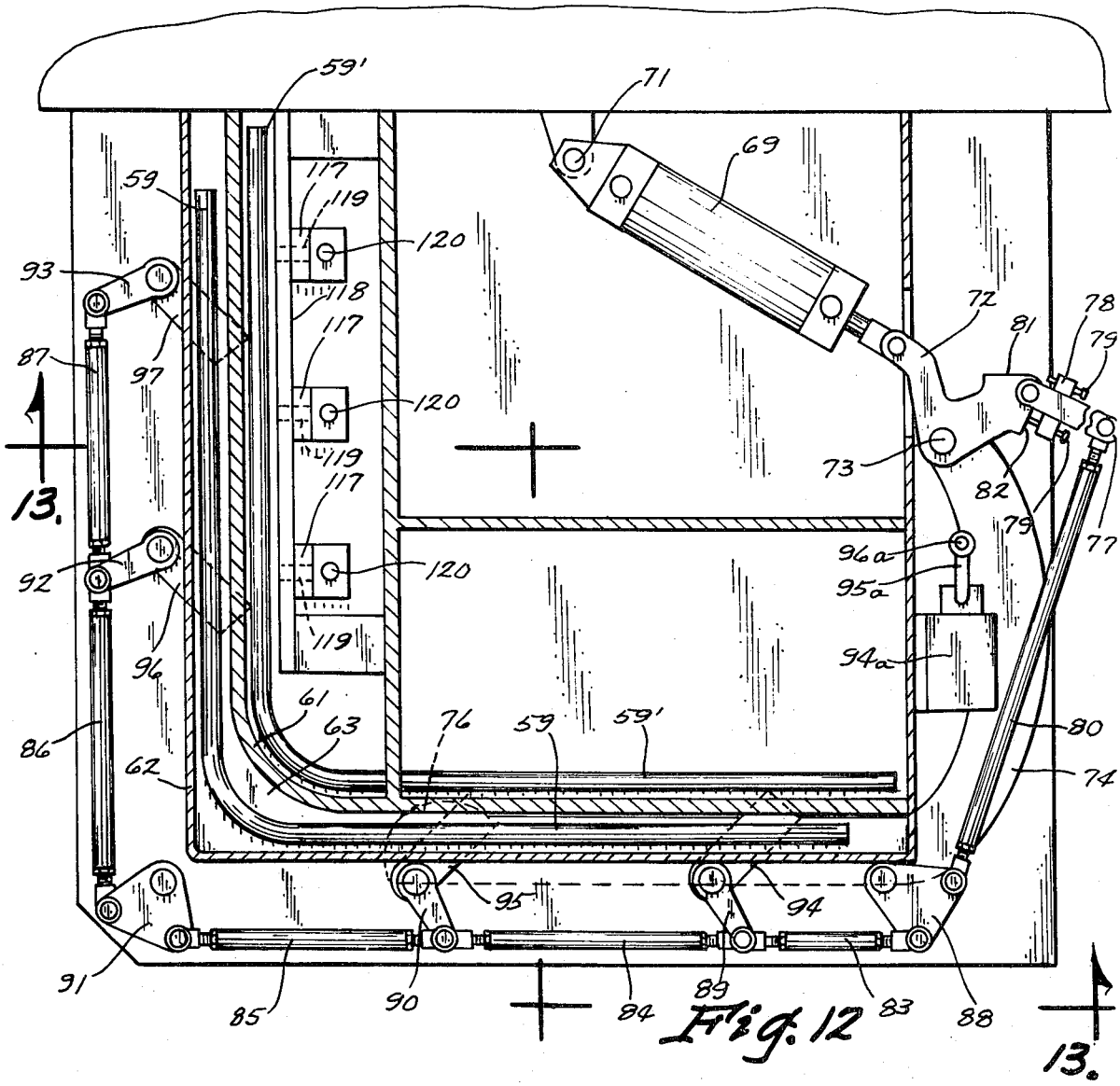
FIG. 12 is a cross-sectional view through the top of the tie bar inserting mechanism looking from above.
Figure 13:
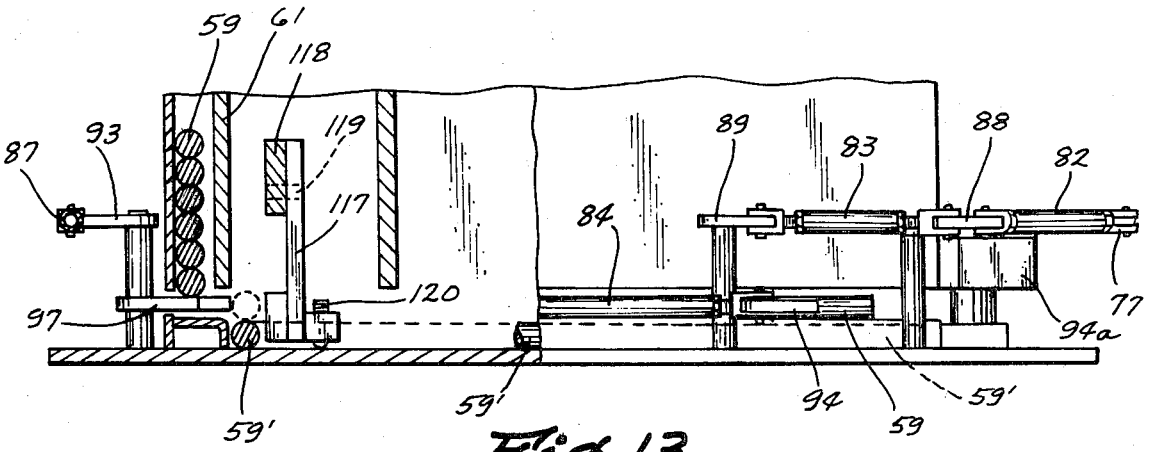
FIG. 13 is a cross-sectional view taken along line 13—13 of FIG. 12.
Figure 14:
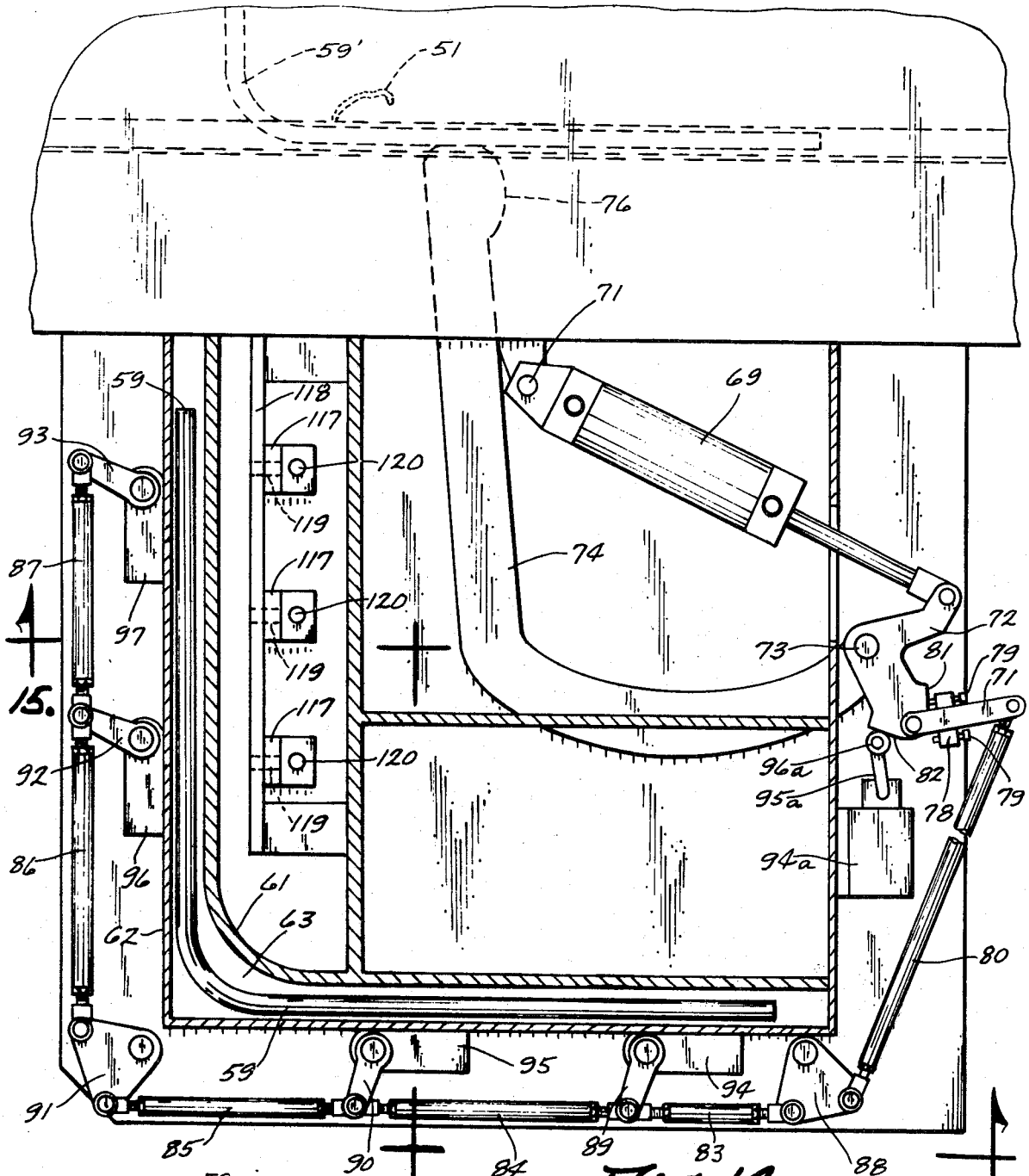
FIG. 14 is a view like FIG. 12, but showing the tie bar inserting mechanism in a different position thereof.
Figure 15:
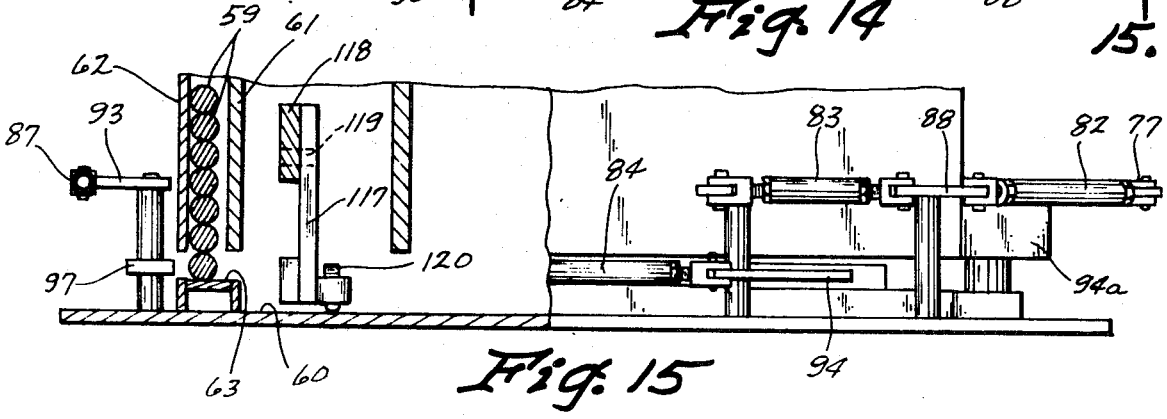
FIG. 15 is a partial cross-sectional view taken along line 15—15 of FIG. 14.
Figure 21:
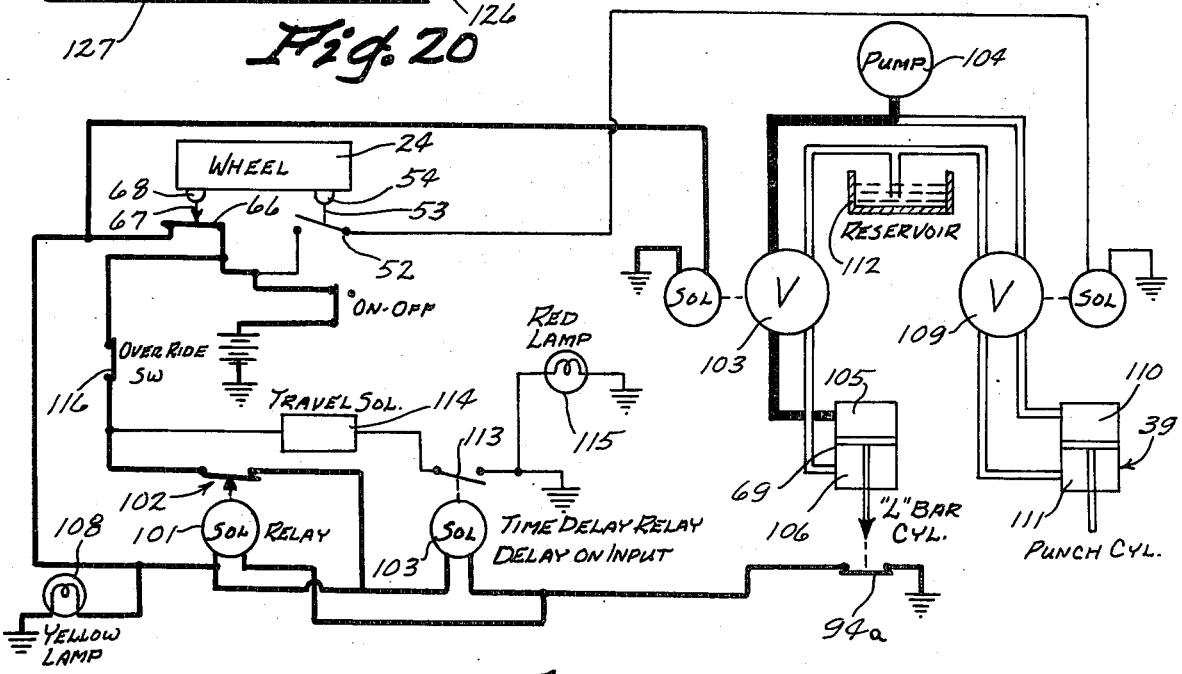
FIG. 21 is a schematic view of the control system for the present invention showing the start of a normal cycle.
Figure 22:
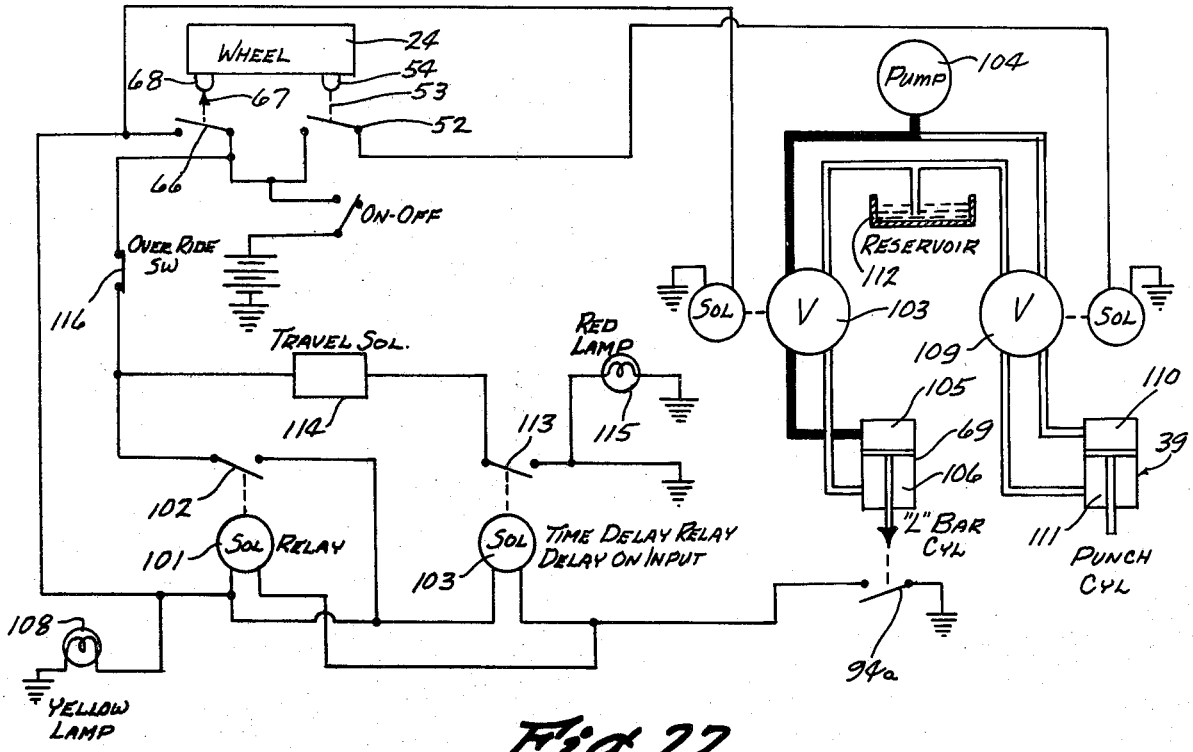
FIG. 22 is a view of the schematic of FIG. 21, but emphasizing another portion of the cycle of the punch and tie bar inserting mechanism.
Figure 23:
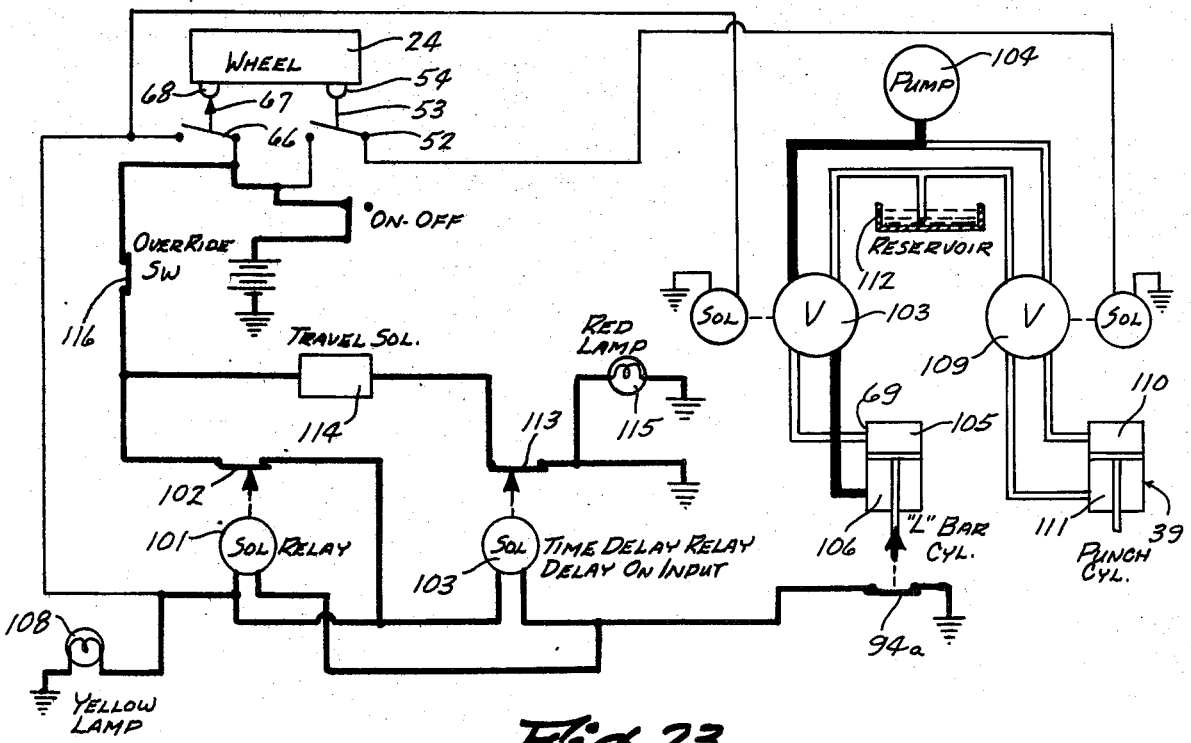
FIG. 23 shows the same schematic as FIGS. 21 and 22, but illustrates the sequence of operation if a tie bar should jam.

Upon actuation of the switch 66 by contact with the cam 68, in its simplest form this can be thought of as the means for actuating the tie bar insertion mechanism 56, although this will be referred to more specifically in the description of the schematic diagrams of FIGS. 21–23. Once the tie bar insertion mechanism 56 is actuated, a double-acting hydraulic cylinder 69 is caused to move from a shortened position as shown in FIG. 12 to a lengthened position as shown in FIG. 14. The hydraulic cylinder 69 is pivotally attached at one end thereof by a pin 71 to the framework of the machine; and, at the other end, it is pivotally attached to a bracket member 72. This bracket member 72 is also pivotally attached to the framework by means of a pin 73. Rigidly attached to the member 72 is an actuating arm 74 which has a rounded portion 76 on one end thereof for contacting the bars 59 and pushing them through the opening 49 in the metallic keyway liner 19. Also pivotally attached to the member 72 is a linkage 77. This linkage 77 has a set screw adjustment mechanism 78 rigidly attached thereto and a pair of set screw devices 79 on each end thereof for cooperation with the surfaces 81 and 82 of the member 72. These set screw devices are used to adjust how much of the stroke of the cylinder 69 is used to push on the linkage 77 for reasons which will be explained below. Additional linkage members 80, 83, 84, 85, 86 and 87 are also disposed about the outer edge of the tie bar insertion mechanism 56 and are attached, respectively, to members 88, 89, 90, 91, 92 and 93, which are also pivotally attached to the framework of the machine. The levers 89, 90, 92 and 93 also have cam members 94, 95, 96 and 97 rigidly attached thereto for reasons which will be explained below. A switch **94*a* is also rigidly attached to the framework of the machine and it has a lever 95*a* and roller 96*a* attached thereto for being actuated by contact with the surface 82 of the member 72**.

In operation, as the machine 10 advances along, the liner material 19 will be pulled off of the roller spool 16 and 17 and will be guided through the rollers 21–23, over the wheel 24, through the forming rollers of FIGS. 8 and 9, through the punching section shown in FIGS. 10 and 11, and through the tie bar insertion mechanism 56.

Once the cam 68 of the wheel 24 actuates the switch 66, then a solenoid 101 will be actuated to close a switch 102. The closing of the switch 102 causes the time delay relay mechanism 103 to be actuated and at the same time, the electrically actuated solenoid valve 103 is moved to the position such that the hydraulic cylinder 69 of the tie bar insertion mechanism 56 will begin to move because hydraulic fluid from the pump 104 will be introduced into the portion 105 of the cylinder 69 and will be exhausted from the portion 106 of the hydraulic cylinder 69 so that the shaft 107 of the hydraulic cylinder 69 will tend to move downwardly toward the switch 94*a*. In actuality, the switch 94 contacts the member 72, and not directly onto the shaft 107 of the hydraulic cylinder 69. During this time when the actuating arm 74 is moving, the yellow lamp 108 is on to indicate to the operator that the tie bar 59 is being inserted into the keyway.

Referring now to FIG. 22, it is noted that at the end of the stroke of the cylinder 69 that the switch 94*a* is opened. The micro switch arm 67 drops off of the cam 68 and the switch 66 is again open. With the switches 94 and 66 open, the relay 101 drops out and the switch 102 opens. Consequently the timer in the delay relay 103 stops and resets for the next cycle. The solenoid operated valve 103 is biased to the position shown in FIG. 23 in which the high pressure from the pump 104 is in communication with the chamber 106 of the hydraulic cylinder 69 so as to retract and shorten the effective length of the hydraulic cylinder 69.

It is noted that the wheel 24 in FIGS. 21–23 shows the cam 54 controlling the switch 52 through a member 53. When the cam 54 contacts the member 53, the switch 52 closes and this causes the solenoid valve 109 to direct high pressure fluid into the chamber 110 and communicate the chamber 111 of the hydraulic cylinder 39 with the reservoir 112 so that the cylinder 39 will be extended and cause the punch to operate. Once the member 53 slips off of the cam 54, because the cam is moving, then the switch 52 will move to the open position again and this will allow the solenoid valve 109 to move to the position to which it is biased; whereby the high pressure fluid from the pump 104 will be directed to the chamber 111 of the cylinder 39 and the chamber 110 and the reservoir 112 will be placed into communication whereby the punch cylinder 39 will retract.

It has been determined that there could be occassions when the tie bar 59' being inserted would not, in fact, be completely inserted into the keyway opening 49. When this happens, the machine continues to move forwardly and pulls the keyway liner 19 with it, thereby ruining everything that has been accomplished and causing the liner 19 to break. Once this occurs, then it is a very complicated and timely procedure to place everything in working condition again. The down time on a very expensive machine, the labor costs of having certain laborers idle while others are working on this maintenance problem, all contributes to the undesirability of having this happen. Consequently, there is a fail-safe mechanism disclosed. Referring specifically to FIG. 23 it is noted that if a bar 59 were to jam such that the arm 74 does not complete a cycle within a set amount of time set on the time delay relay mechanism 103, then the machine would be shut down completely and the problem can be solved before any damage is done. Assuming that the machine is operating as described above with respect to FIG. 21 and the cylinder 69 does not make a full stroke, then the switch 94*a* would not open. Consequently, the timer 103 would close the switch 103 before or after the switch 66 opens, depending upon the speed of the wheel 24 or the number of seconds that the delay 103 has set on its timer. When the switch 113 closes at the end of a pre-set time, then this actuates the travel solenoid 114 which stops the forward motion of the machine 10. Also, a red lamp 115 is lit up to tell the operator of the machine that it is this mechanism which stopped the machine and not something else. Once the problem is fixed, that is, the jamming of the tie bar is alleviated, then an override switch 116 is actuated which returns all of the components back to their normal operating positions.

Returning more specifically to the functioning of the tie bar insertion mechanism 56 shown in FIGS. 12–15, it is noted that the arm 74 is initially in the position shown in FIG. 12. Also, the cams 94–97 are in the position shown in FIG. 12. As the cylinder 69 begins to lengthen, the set screw 79 will contact the surface 82 of the member 72 and this will initially cause the cams 94–97 to move to the position shown in FIG. 14, whereby the column of bars 59 will drop down upon the shelf 63. As the cylinder 69 continues to lengthen, the member 74 will move continually to the position shown in FIG. 14 and this movement will push the bar 59', which is moved back off of the shelf 63 and onto the supporting surface 60. Once this bar 59' is in the position shown in dashed lines in FIG. 14, then the cylinder 69 will begin to close and retract as discussed above and the arm 74 will begin to move back to the position as shown in FIG. 12. Before the arm 74 actually reaches the position shown in FIG. 12, but when it is near that position, the set screw device 79 will contact surface 81 of the member 72 and this contact will move the linkage 77 and, thereby, all of the linkage members 82–87, thereby causing the cams 94–97 to move back to the position shown in FIG. 12 and pushing the bottom-most of the bars 59 off of the shelf 63 and onto the supporting surface 60 in front of the arm 74. In other words, the arm 74 is allowed to move on past the position of the supporting surface 60 before the cams 94–97 push the bar 59 down. Consequently, it can be seen that the mechanisms shown in FIGS. 12–15 are operable to move the linkages 80 and 83–87, and, thereby, linkages 88–93 and, thereby, the cams 94–97 only at the beginning and at the end of the cycle.

Also shown in FIGS. 12–15 are guiding structures 117. These guiding structures 117 are pivotally mounted at the top thereof to a structural member 118 by means of pins 119. These members 117 hang downwardly by gravity and prevent the bar 59' from becoming turned. As the arm member 74 moves from the position shown in FIG. 12 to the position shown in FIG. 14, the bar 59' is pushed against each of the members 117, thereby, causing them to pivot upwardly, thereby allowing the following leg of the tie bar 59' to pass thereunder as it is pushed towards the opening 49 in the liner 19. Consequently, it can be easily appreciated that these members 117 will tend to guide the tie bar 59', but will allow it and the members 74 to pass thereunder. Set screws 120 are set so that they just reach the surface 60, but they must be high enough to allow the member 117 to swing both ways, so as to allow the tie bar 59' and the arm 72 to pass thereunder during the insertion stroke, and yet allow the arm 74 to again pass thereunder so that the members 117 swing the other way during this time when the arm 74 is returning from the position shown in FIG. 14 to the position shown in FIG. 12.

Figure 16:
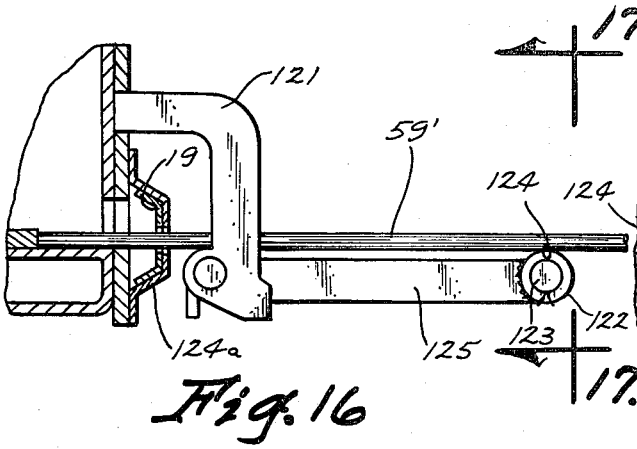
FIG. 16 is a view taken along line 16—16 of FIG. 2.
Figure 17:
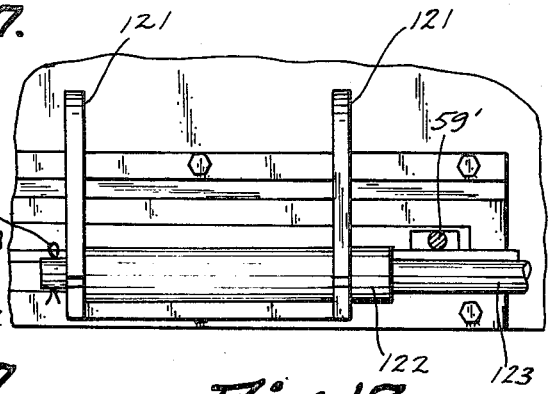
FIG. 17 is a view taken along line 17—17 of FIG. 16.

Referring to FIGS. 16 and 17, it is noted that support members 121 are rigidly attached to the framework for the purpose of supporting a member 122, which in turn, supports a member 123 which is inserted within the tubular member 122 and has a cotter key 124 therethrough for maintaining it in this position. The member 123 extends forwardly and holds the bar 59' upwardly while the machine lays the concrete and passes thereover, especially while the vibrators (not shown) associated with this type of machine are close by, since vibrations of the concrete with these member 59' therein would cause them to pivot downwardly and not be held in the position in FIG. 18, as is desired. A guide member **124*a* is also shown, and this guide member 124*a* is part of the slip forming mechanism which causes the concrete to have the keyway formed therein, and also guides the lining strip 19. A bar member 125 connects the members 121 and 122** together.

Figure 20:
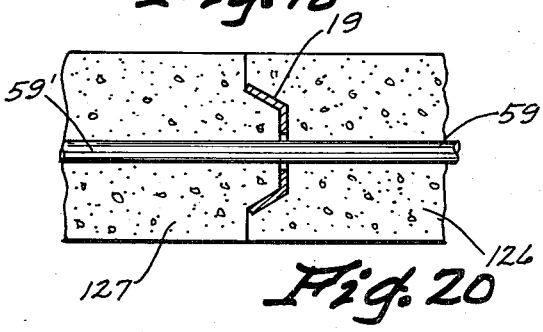
FIG. 20 is a partial cross-sectional view taken along line 20—20 of FIG. 19.

FIGS. 18–20 show the finished product. FIG. 18, for example, shows the completed slab 126 with the tie bar 59' inserted therein and shows in dashed lines how it would be bent outwardly for reception of another slab 127. FIG. 19 shows this other slab 127 which would be formed by a slip forming machine in a similar fashion. Consequently, the keyway formed between these slabs 126 and 127 prevent vertical movement of one of the slabs with respect to the other, and the tie bar 59' prevents the slabs from moving apart. This is shown clearly, also, in FIG. 20.

Obviously, many modifications and variations of the present invention are possible in light of the above teachings. It is therefore to be understood that, within the scope of the appended claims, the invention may be practiced otherwise than as specifically described.

I claim:

1. Apparatus for continuously laying concrete comprising:

a movable frame;

means attached to said frame for receiving concrete in a plastic condition;

slipforming means attached to said frame behind said receiving means for shaping said concrete into an elongated concrete slab;

means attached to said frame for forming a continuous groove in at least one edge of said concrete slab;

means attached to said frame for lining said groove with a lining;

means attached to said frame for punching a plurality of holes in said lining;

means attached to said frame for automatically placing bars through said openings; and means operably attached to said frame for shutting off said apparatus if said bar placing means malfunctions.

2. Bar placing means comprising;

a housing;

magazine means attached to said housing for holding a plurality of bars;

shelf means attached to said housing for supporting the lowermost of said bars;

bar receiving means attached to said housing for receiving one bar at a time from said magazine means;

arm means operably attached to said housing for moving said one bar into a slab of uncured concrete and being movable between a first position in readiness to insert said one bar and a second position wherein said one bar is fully inserted;

power means operably attached to said housing for moving said arm means between said first and second position; and feeding means attached to said power means for moving the lowermost bar on said shelf from the shelf to said bar receiving means when said arm means returns substantially to said first position from said second position.

3. The apparatus of claim 2 including guide means associated with said bar receiving means for guiding said one bar into said slab of concrete.

4. The apparatus of claim 1 wherein said means for shutting off said apparatus includes means operable for actuating said shutting off means if said arm means does not move from the first to the second position thereof within a predetermined amount of time.

5. The apparatus of claim 2 including lost motion means connected to said power means and to said feeding means for causing said power means to move said feeding means only when the arm means is near said first and said second positions whereby a bar will be inserted into said bar receiving means only after said one bar is inserted and said arm means has moved substantially back to the first position thereof.

6. The apparatus of claim 5 wherein said feeding means includes a plurality of cams for pushing said lowermost bar off of said shelf and linkage means connecting all of said cams together for moving the cams in unison.

7. The apparatus of claim 6 wherein said bars include two straight portions connected together and disposed at substantially a right angle with respect to each other.

8. The apparatus of claim 2 wherein said power means includes a hydraulic cylinder.

9. The apparatus of claim 1 wherein said punching means includes hydraulic cylinder means for actuation thereof.

* * * * *